US008028523B2

(12) United States Patent
Wikström et al.

(10) Patent No.: US 8,028,523 B2
(45) **Date of Patent: *Oct. 4, 2011**

(54) ARRANGEMENT FOR RECIRCULATION OF EXHAUST GASES OF A SUPERCHARGED INTERNAL COMBUSTION ENGINE

(75) Inventors: Hans Wikström, Johanneshov (SE); Zoltan Kardos, Södertälje (SE)

(73) Assignee: Scania CV AB (SE)

( * ) Notice: Subject to any disclaimer, the term of this patent is extended or adjusted under 35 U.S.C. 154(b) by 718 days.

This patent is subject to a terminal disclaimer.

(21) Appl. No.: 12/067,331

(22) PCT Filed: Sep. 4, 2006

(86) PCT No.: PCT/SE2006/050312

§ 371 (c)(1),
(2), (4) Date: Mar. 19, 2008

(87) PCT Pub. No.: WO2007/055644

PCT Pub. Date: May 18, 2007

(65) Prior Publication Data

US 2008/0256949 A1 Oct. 23, 2008

(30) Foreign Application Priority Data

Sep. 20, 2005 (SE) ..... 0502075

(51) Int. Cl.

| | |
|---|---|
| ***F02B 33/44*** | (2006.01) |
| ***F02B 19/04*** | (2006.01) |
| ***F02B 47/08*** | (2006.01) |
| ***F02M 25/07*** | (2006.01) |

(52) U.S. Cl. ..... 60/605.2; 60/599; 123/568.12

(58) Field of Classification Search ..... 60/605.2, 60/599; 123/568.12, 568.11, 41.01; *F02M 25/07; F02B 29/04*

See application file for complete search history.

(56) References Cited

U.S. PATENT DOCUMENTS

| | | | | |
|---|---|---|---|---|
| 6,185,939 | B1 | 2/2001 | Coleman et al. | 60/605.2 |
| 6,244,256 | B1 | 6/2001 | Wall et al. | 123/568.12 |
| 6,935,319 | B2 | 8/2005 | Aupperle et al. | 123/568.12 |
| 7,451,749 | B2 * | 11/2008 | Kardos | 123/568.12 |
| 7,536,998 | B2 * | 5/2009 | Held et al. | 123/568.12 |
| 7,584,749 | B2 * | 9/2009 | Kardos et al. | 123/568.12 |

(Continued)

FOREIGN PATENT DOCUMENTS

DE 4240239 A1 * 6/1994

(Continued)

OTHER PUBLICATIONS

International Search Report mailed Dec. 5, 2006 in corresponding PCT International Application No. PCT/SE2006/050312.

*Primary Examiner* — Thai Ba Trieu
(74) *Attorney, Agent, or Firm* — Ostrolenk Faber LLP

(57) ABSTRACT

An arrangement for recirculation of exhaust gases of a supercharged combustion engine in a vehicle. A first EGR cooler effects a first step of cooling the recirculating exhaust gases in the return line by means of a cooling medium in the form of a cooling air flow, and a second EGR cooler effects a second step of cooling the recirculating exhaust gases in the return line by means of a cooling medium which is at substantially the temperature of the surroundings. The first EGR cooler is fitted in an internal region of the vehicle which is adapted to have the cooling air flow passing through it during operation of the combustion engine.

11 Claims, 2 Drawing Sheets

U.S. PATENT DOCUMENTS

| | | | | |
|---|---|---|---|---|
| 7,617,679 | B2 * | 11/2009 | Kardos et al. | 60/605.2 |
| 2007/0245716 | A1 * | 10/2007 | Kardos et al. | 60/278 |
| 2008/0047267 | A1 * | 2/2008 | Kardos et al. | 60/605.2 |
| 2008/0047533 | A1 * | 2/2008 | Kardos | 123/568.12 |
| 2008/0053090 | A1 * | 3/2008 | Kardos et al. | 60/605.2 |
| 2008/0135028 | A1 * | 6/2008 | Kardos et al. | 123/568.12 |
| 2008/0202725 | A1 * | 8/2008 | Kardos et al. | 123/568.12 |
| 2008/0271451 | A1 * | 11/2008 | Kardos et al. | 60/605.2 |
| 2009/0159021 | A1 * | 6/2009 | Kardos | 123/41.12 |
| 2009/0277428 | A1 * | 11/2009 | Marsh et al. | 123/568.12 |
| 2009/0277722 | A1 * | 11/2009 | Kardos | 184/6.12 |
| 2009/0320467 | A1 * | 12/2009 | Kardos et al. | 60/605.2 |
| 2010/0006043 | A1 * | 1/2010 | Kardos et al. | 123/568.12 |
| 2010/0065024 | A1 * | 3/2010 | Kardos et al. | 123/540 |
| 2010/0089088 | A1 * | 4/2010 | Kardos et al. | 62/323.1 |
| 2010/0242929 | A1 * | 9/2010 | Kardos et al. | 123/568.12 |
| 2010/0263369 | A1 * | 10/2010 | Kardos et al. | 60/599 |

FOREIGN PATENT DOCUMENTS

| | | | | |
|---|---|---|---|---|
| JP | 2001152861 | A | * | 6/2001 |
| JP | 2005127137 | A | * | 5/2005 |
| JP | 2007092715 | A | * | 4/2007 |
| WO | WO 2004044401 | A1 | * | 5/2004 |
| WO | WO 2004051069 | A1 | * | 6/2004 |
| WO | WO 2005073535 | A1 | * | 8/2005 |
| WO | WO 2005116437 | A1 | * | 12/2005 |
| WO | WO 2005116438 | A1 | * | 12/2005 |
| WO | WO 2008069743 | A1 | * | 6/2008 |

* cited by examiner

ARRANGEMENT FOR RECIRCULATION OF EXHAUST GASES OF A SUPERCHARGED INTERNAL COMBUSTION ENGINE

CROSS REFERENCE TO RELATED APPLICATION

The present application is a 35 U.S.C. §§371 national phase conversion of PCT/SE2006/050312, filed 4 Sep. 2005, which claims priority of Swedish Application No. 0502075-5, filed 20 Sep. 2005. The PCT International Application was published in the English language.

BACKGROUND TO THE INVENTION, AND STATE OF THE ART

The present invention relates to an arrangement for recirculation of exhaust gases of a supercharged combustion engine and for cooling the gases during recirculation.

The technique known as EGR (Exhaust Gas Recirculation) is a known means of leading part of the exhaust gases from a combustion process in a combustion engine back, via a return line, to an inlet line for supply of air to the combustion engine. A mixture of air and exhaust gases is thus supplied via the inlet line to the engine's cylinders in which the combustion takes place. Adding exhaust gases to the air causes a lower combustion temperature which results inter alia in a reduced content of nitrogen oxides $NO_x$ in the exhaust gases. This technique is used for both Otto engines and diesel engines.

The amount of air which can be supplied to a supercharged combustion engine depends on the pressure of the air but also on the temperature of the air. In order to supply as large an amount of air as possible to the combustion engine, the compressed air is cooled in a charge air cooler before it is led to the combustion engine. The compressed air is cooled in the charge air cooler by means of ambient air. The compressed air can thus be cooled to a temperature which exceeds the temperature of the surroundings by only a few degrees. In cases where EGR technology is used, the returned exhaust gases are cooled by means of a so-called EGR cooler. Conventional EGR coolers use as cooling medium the coolant in the vehicle's ordinary cooling system for cooling the combustion engine. Conventional EGR coolers are therefore subject to the limitation that the exhaust gases cannot be cooled to a lower temperature than the temperature of the coolant in the cooling system, which during normal operation is of the order of 70-90° C. The cooled exhaust gases are therefore usually at a definitely higher temperature than the cooled compressed air when they mix in the inlet line to the combustion engine. The mixture of exhaust gases and air which is led to the combustion engine will therefore be at a higher temperature than the compressed air which is led into a supercharged combustion engine not provided with recirculation of exhaust gases. The performance of a supercharged combustion engine equipped with EGR will thus be somewhat inferior to that of a corresponding supercharged combustion engine not equipped with EGR.

SUMMARY OF THE INVENTION

The object of the present invention is to provide an arrangement which effects simple but effective cooling of the returned exhaust gases so that they can be cooled to substantially the same temperature level as the air which is led to the combustion engine.

This object is achieved with the arrangement of the kind mentioned in the introduction modified by the invention. The compressed air in the inlet line is usually cooled in a charge air cooler by an air flow which is at the temperature of the surroundings. The charge air cooler is usually situated at a peripheral position in the vehicle ahead of the vehicle's ordinary radiator so that the charge air can be cooled by air which is at the temperature of the surroundings. In a vehicle there is great competition for space. There is therefore not usually sufficient peripheral space in the vehicle for fitting a large EGR cooler which can cool the returned exhaust gases in one step from a temperature of about 600° C. to substantially the temperature of the surroundings. According to the invention, this problem is solved by using a first EGR cooler which effects a first step of cooling the exhaust gases and a second EGR cooler which effects a second step of cooling the exhaust gases. Air at a higher temperature than the surroundings can thus be used for effecting the first step of cooling the exhaust gases. The first EGR cooler therefore need not be at a peripheral position in the vehicle and need not be in contact with air which is at the temperature of the surroundings. With advantage, the exhaust gases undergo their main temperature decrease in such an internally fitted first EGR cooler. The second EGR cooler may therefore be relatively small. There is usually space for fitting such a small second EGR cooler at a peripheral position in the vehicle where air which is at the temperature of the surroundings flows through it. To enable the first EGR cooler to cool the exhaust gases effectively, it is fitted in an internal region of the vehicle through which air flows. The air in the internal region of the vehicle is usually at a definitely higher temperature than ambient air but is certainly usable for an effective first step of cooling the exhaust gases.

According to a preferred embodiment of the present invention, the first EGR cooler is fitted in an internal region of the vehicle situated downstream from an ordinary air-cooled radiator in the vehicle with respect to the intended direction of air flow through the ordinary radiator. The ordinary radiator may form part of a cooling system for cooling the combustion engine, in which case the air which passes through the ordinary radiator will flow thereafter through the first EGR cooler. After passing through the ordinary radiator, the air may be at a temperature of about 70° C. It is therefore possible to cool the exhaust gases to just above this temperature as a first step. With advantage, the first EGR cooler is fitted in a region situated between the ordinary radiator and the radiator fan whose function it is to cause the air flow through the ordinary radiator. Such positioning of the first EGR cooler ensures ample air flow for effecting the first step of cooling the exhaust gases.

According to another embodiment of the invention, the arrangement comprises a separate radiator fan situated close to the first EGR cooler and having the function of causing an air flow through the first EGR cooler. With such a separate radiator fan it is possible to fit the first EGR cooler at substantially any desired internal position in the vehicle. With advantage, the first EGR cooler is situated in a region close to the combustion engine, making it possible for the return line for the exhaust gases to be relatively short. The first EGR cooler may be fitted to the combustion engine, making it possible for the return line to be very short, in which case the first EGR cooler may be fastened to the combustion engine either directly or indirectly via suitable connecting elements.

According to another preferred embodiment of the invention, the second EGR cooler is situated in a peripheral region of the vehicle where it is cooled by air which is at the temperature of the surroundings. With a relatively large first EGR cooler, the second EGR cooler can be quite small and occupy little space. Such a second EGR cooler may be fitted in any desired peripheral region of the vehicle where it is in contact with ambient air. The second EGR cooler may be situated in a region which is upstream from the ordinary radiator with respect to the intended direction of air flow through the ordinary radiator, in which case the second cooler may be situated beside the charge air cooler ahead of the ordinary radiator.

According to another embodiment of the invention, the second EGR cooler is fitted in an internal region of the vehicle and forms part of a separate cooling circuit with a circulating liquid cooling medium. In this case both the first EGR cooler and the second EGR cooler may be fitted close to the combustion engine, making it possible for the return line to be of substantially minimal extent. With advantage, the separate cooling circuit comprises a radiator element situated in a peripheral region of the vehicle where it is cooled by ambient air. A radiator element in which a liquid cooling medium is cooled can be of more compact design than a radiator element in which a gaseous cooling medium is cooled. Such a radiator element occupies very little space and there is nearly always an accessible peripheral space in the vehicle where it can be fitted.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE INVENTION

Figure 1:
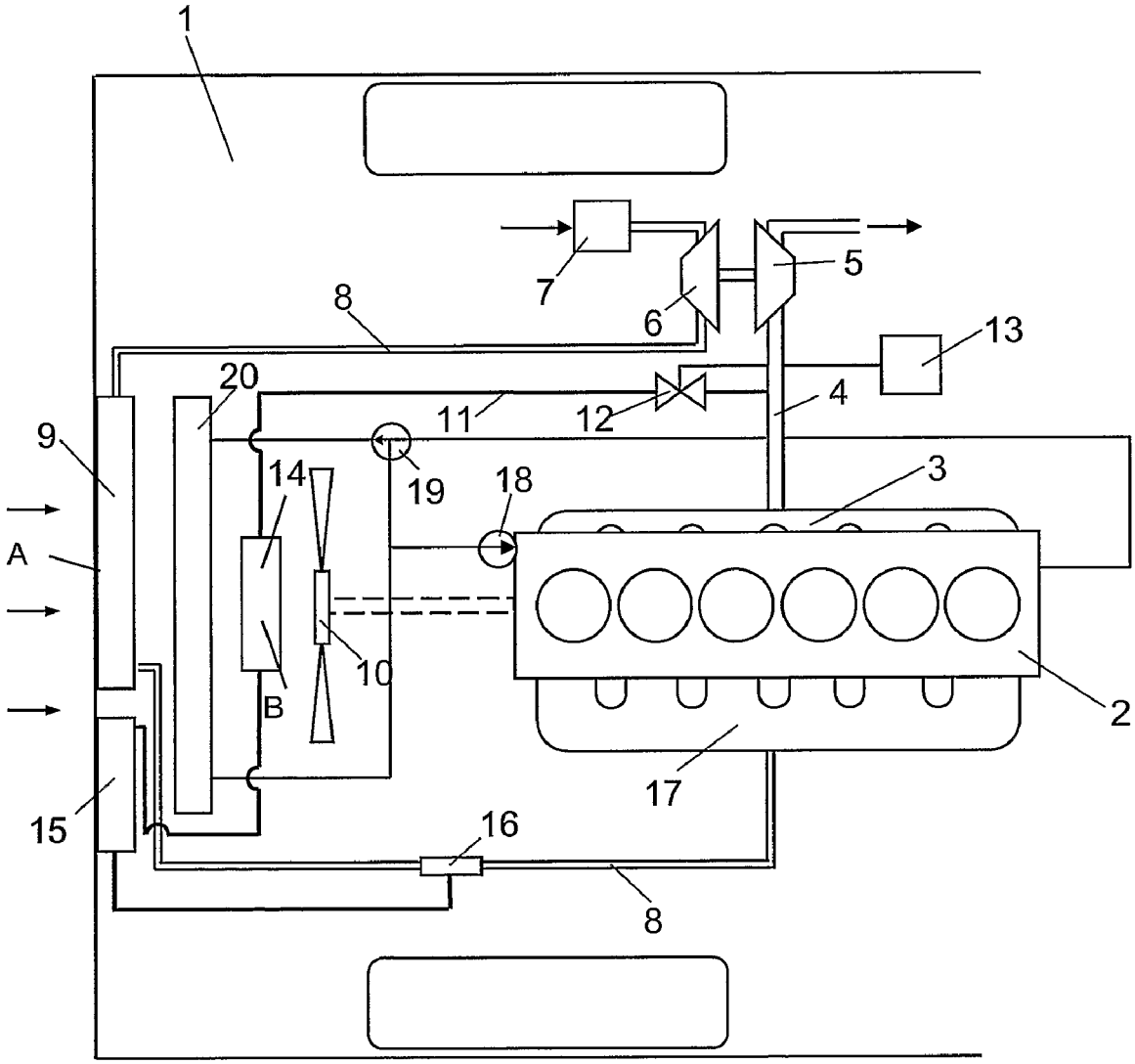
FIG. 1 depicts an arrangement for recirculation of exhaust gases of a supercharged diesel engine according to a first embodiment of the invention and FIG. 2 depicts an arrangement for recirculation of exhaust gases of a supercharged diesel engine according to a second embodiment of the invention.

FIG. 1 depicts an arrangement for recirculation of exhaust gases of a supercharged combustion engine in a vehicle 1. The combustion engine in this case is exemplified as a diesel engine 2. Such recirculation is usually called EGR (Exhaust Gas Recirculation). Adding exhaust gases to the compressed air which is led to the engine's cylinders lowers the combustion temperature and hence also the content of nitrogen oxides ($NO_x$) formed during combustion processes. The diesel engine 2 may be intended to power a heavy vehicle 1. The exhaust gases from the cylinders of the diesel engine 2 are led via an exhaust manifold 3 to an exhaust line 4. The exhaust gases in the exhaust line 4, which are at above atmospheric pressure, are led to a turbine 5. The turbine 5 is thus provided with driving power which is transmitted, via a connection, to a compressor 6. The compressor 6 thus compresses the air which is led, via an air filter 7, into an inlet line 8. A charge air cooler 9 is arranged in the inlet line 8. The charge air cooler 9 is arranged in a peripheral region A of the vehicle 1, which in this case is at a front portion of the vehicle 1. The function of the charge air cooler 9 is to cool the compressed air before it is led to the diesel engine 2. The compressed air is cooled in the charge air cooler 9 by ambient air which is caused to flow through the charge air cooler 9 by a radiator fan 10. The radiator fan 10 is driven by the diesel engine 2 via a suitable connection.

An arrangement for effecting recirculation of part of the exhaust gases in the exhaust line 4 comprises a return line 11 which extends between the exhaust line 4 and the inlet line 8. The return line 11 comprises an EGR valve 12 by which the exhaust flow in the return line 11 can be shut off. The EGR valve 12 can also be used for controlling steplessly the amount of exhaust gases led from the exhaust line 4 via the return line 11 to the inlet line 8. A control unit 13 is adapted to controlling the EGR valve 12 on the basis of information about the prevailing operating state of the diesel engine 2. The control unit 13 may be a computer unit provided with suitable software. The return line 11 comprises a first EGR cooler 14 for effecting a first step of cooling the exhaust gases and a second EGR cooler 15 for effecting a second step of cooling the exhaust gases. In certain operating states of supercharged combustion engines 2, the pressure of the exhaust gases in the exhaust line 4 is lower than the pressure of the compressed air in the inlet line 8. In such operating situations it is not possible to mix the exhaust gases in the return line 11 directly with the compressed air in the inlet line 8 without special auxiliary means. A venturi 16 may for example be used for the purpose. If the combustion engine 2 is instead a supercharged Otto engine, the exhaust gases in the return line 11 can be led directly into the inlet line 8, since the exhaust gases in the exhaust line 4 of an Otto engine in substantially all operating states will be at a higher pressure than the compressed air in the inlet line 8. When the exhaust gases have mixed with the compressed air in the inlet line 8, the mixture is led to the respective cylinders of the diesel engine 2 via a manifold 17. The diesel engine 2 is cooled in a conventional manner by a cooling system which contains a circulating coolant. The coolant is circulated in the cooling system by a coolant pump 18. The cooling system also comprises a thermostat 19 and a radiator 20 which is fitted at a forward portion of the vehicle 1 behind the charge air cooler 9.

During operation of the diesel engine 2, the exhaust gases in the exhaust line 4 drive the turbine 5 before they are led out to the surroundings. The turbine 5 is thus provided with driving power which drives the compressor 6. The compressor 6 compresses the air which is led, via the air filter 7, into the inlet line 8. The compressed air is cooled in the charge air cooler 9, which is situated in a peripheral region A at a forward portion of the vehicle 1. The compressed air is cooled in the charge air cooler 9 by air which is at the temperature of the surroundings. In this case the compressed air can be cooled to a temperature which exceeds the temperature of the surroundings by only a few degrees. In most operating states of the diesel engine 2, the control unit 13 holds the EGR valve 12 open so that part of the exhaust gases in the exhaust line 4 is led into the return line 11. The exhaust gases in the return line 4 are usually at a temperature of about 500-600° C. when they reach the first EGR cooler 14. The first EGR cooler 14 is fitted in an internal region B of the vehicle which is situated between the radiator 20 and the radiator fan 10. The existing radiator fan 10 thus also causes an ample air flow through the first EGR cooler 14. However, the air which flows through the first EGR cooler 14 is at a higher temperature than ambient air because of having undergone heating while passing through the charge air cooler 9 and the radiator 20. When this air flow reaches the first EGR cooler 14, it is, during normal operation of the vehicle, at a temperature within the range 70-100° C. With advantage, however, this air flow may be used for effecting a first step of cooling the returned exhaust gases, since the temperature of this air is considerably lower than the temperature of the exhaust gases. The returning exhaust gases can thus be subjected to a first step of cooling to a temperature close to the temperature of this air. Thereafter the exhaust gases are led to the second EGR cooler 15 situated in a peripheral region A of the vehicle beside the charge air cooler 9. There will thus be an assured flow of air which is at the temperature of the surroundings through the second EGR cooler 15. With a suitably dimensioned second EGR cooler 15, the returned exhaust gases can be cooled by the flow of air to a temperature substantially corresponding to the temperature of the surroundings. Exhaust gases in the return line 11 can thus be subjected to cooling to substantially the same temperature as the compressed air in the charge air cooler 9.

In certain operating states of supercharged diesel engines 2, the pressure of the exhaust gases in the exhaust line 4 is lower than the pressure of the compressed air in the inlet line 8. It is possible, by means of the venturi 16, for the static pressure in the inlet line 8 to be reduced locally, at the connection to the return line 11, so that the exhaust gases can be led in and mixed with the compressed air in the inlet line 8. The mixture of exhaust gases and compressed air is thereafter led to the respective cylinders of the diesel engine 2 via the manifold 17. Two such EGR coolers 14, 15 effect two steps of cooling the recirculating exhaust gases to a temperature substantially corresponding to the temperature of the compressed air after cooling in the charge air cooler 9. The mixture of exhaust gases and compressed air which is led to the diesel engine 2 will thus be at a temperature substantially corresponding to that of the compressed air which is led to a diesel engine without EGR. The present invention thus makes it possible for the performance of a diesel engine equipped with EGR to correspond substantially to that of a diesel engine not equipped with EGR.

Figure 2:
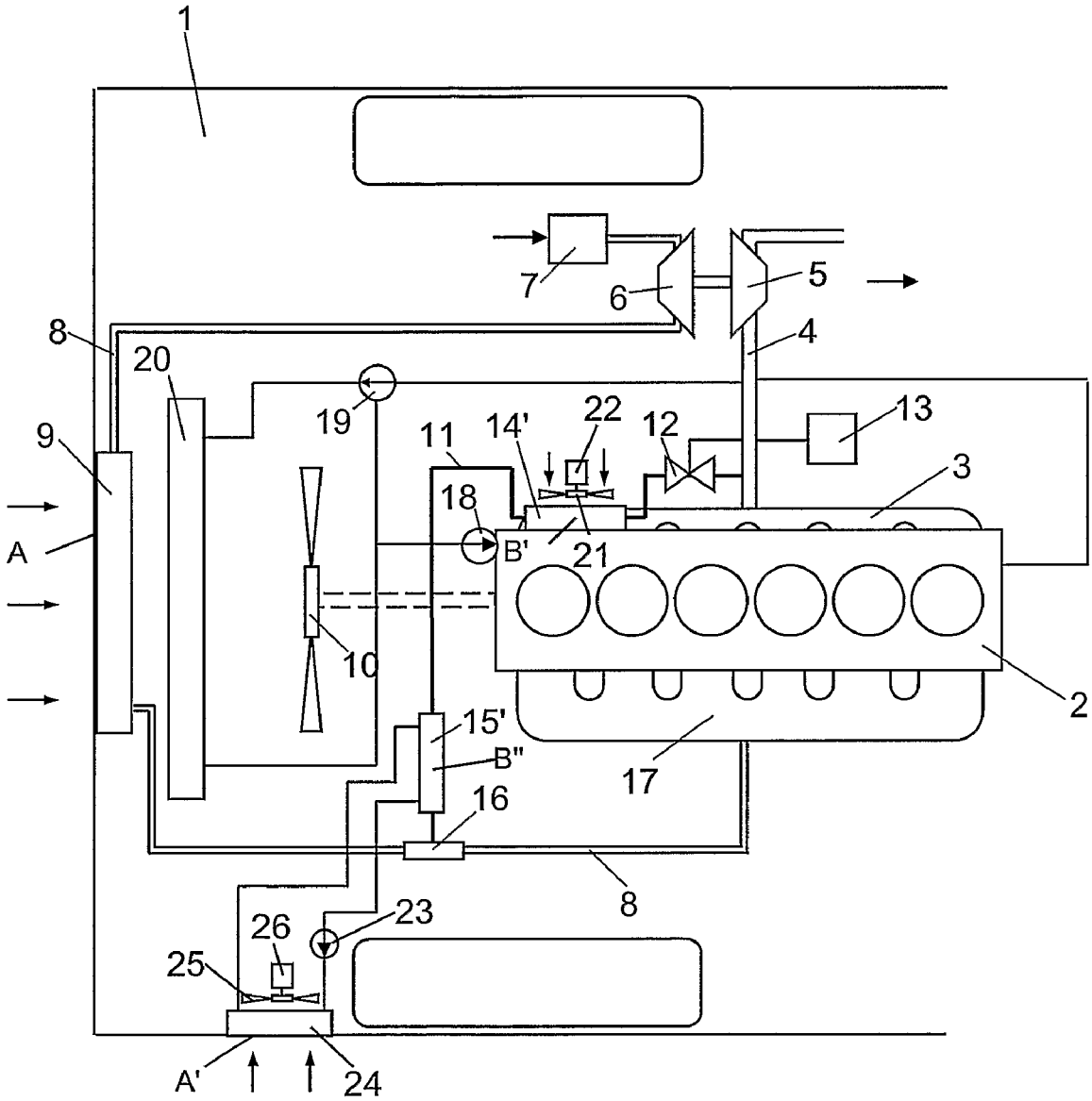

FIG. 2 depicts an alternative arrangement for recirculation of exhaust gases of a diesel engine 2. In this case the return line 11 for recirculation of exhaust gases comprises a first EGR cooler 14' situated in an internal region B' of the vehicle 1 close to the diesel engine 2. The first EGR cooler 14' may be fitted to the diesel engine 2 directly or indirectly. A separate fan 21 driven by an electric motor 22 is arranged in such a position that it can cause an air flow through the first EGR cooler 14'. The air in the vehicle's engine space close to the combustion engine 2 will usually be at a higher temperature than ambient air. The air in the engine space may nevertheless be used for effecting a first step of cooling the returned exhaust gases, since the temperature of this air is considerably lower than the temperature of the exhaust gases. Depending on the capacity of the first EGR cooler 14', the exhaust gases may be subjected to a first step of cooling to a temperature more or less corresponding to the temperature of the air in the engine space.

Thereafter the exhaust gases are led to a second EGR cooler 15' which is also fitted in an internal region B" of the vehicle 1. The second EGR cooler 15' is a component of a separate cooling system with a coolant which is circulated by a coolant pump 23. The separate cooling system also comprises a radiator element 24 fitted in a peripheral region A' of the vehicle 1. In this case the peripheral region A' is situated at a forward side portion of the vehicle 1. A radiator fan 25 is adapted to causing a flow of ambient air through the radiator element 24. The radiator fan 25 is driven by an electric motor 26. The coolant is cooled in the radiator element 24 by air which is at the temperature of the surroundings. It is therefore possible to cool the coolant to a temperature close to the temperature of the surroundings. The returned exhaust gases are cooled in the second EGR cooler 15' by the coolant which is at substantially the temperature of the surroundings. The exhaust gases can thus be subjected to a second step of cooling in the second EGR cooler 15' to a temperature substantially corresponding to the temperature of the surroundings. Exhaust gases in the return line 11 can therefore here again be cooled to substantially the same temperature as the compressed air in the charge air cooler 9.

The invention is in no way limited to the embodiments described with reference to the drawings but may be varied freely within the scopes of the claims. The type of first EGR cooler 14 depicted in FIG. 1 may of course be combined with a second EGR cooler 15' of the type depicted in FIG. 2. It is of course also possible to combine a first EGR cooler 14' as depicted in FIG. 2 with a second EGR cooler 15 of the type depicted in FIG. 1.

The invention claimed is:

1. An arrangement for recirculation of exhaust gases of a supercharged combustion engine, in a vehicle the arrangement comprising:

an exhaust line operable to lead exhaust gases out from the combustion engine, an inlet line operable to lead air at above atmospheric pressure to the combustion engine, a return line which connects the exhaust line to the inlet line enabling recirculation of exhaust gases from the exhaust line to the inlet line via the return line, a first EGR cooler operable for effecting a first step of cooling the recirculating exhaust gases in the return line by a first cooling medium in the form of a cooling air flow the first EGR cooler being fitted in an internal region of the vehicle located to have the cooling air flow passing through it during operation of the combustion engine, and a second EGR cooler operable after the first EGR cooler for effecting a second step of cooling the recirculating exhaust gases in the return line by a second cooling medium which is at substantially the temperature of the surroundings.

2. An arrangement according to claim 1, further comprising an ordinary air cooled radiator in the vehicle, the first EGR cooler is fitted in the internal region of the vehicle and downstream from the radiator with respect to an intended direction of air flow through the radiator.

3. An arrangement according to claim 2, further comprising a radiator fan positioned and operable to cause air flow through the ordinary radiator; and the first EGR cooler is fitted in the internal region of the vehicle which is situated between the ordinary radiator and the radiator fan.

4. An arrangement according to claim 2, wherein the vehicle includes a peripheral region situated upstream from the ordinary air-cooled radiator with respect to an intended direction of air flow through the ordinary radiator, and the second EGR cooler is fitted in the peripheral region of the vehicle.

5. An arrangement according to claim 2, wherein the second EGR cooler is fitted in a peripheral region of the vehicle through which region air at the temperature of the surroundings flows; and the vehicle includes a peripheral region situated upstream from the ordinary air-cooled radiator with respect to an intended direction of air flow through the ordinary radiator, and the second EGR cooler is fitted in the peripheral region of the vehicle.

6. An arrangement according to claim 1, further comprising a separate radiator fan arranged close to the first EGR cooler, and positioned and operable for causing the cooling air flow through the first EGR cooler.

7. An arrangement according to claim 6, wherein the first EGR cooler is fitted in the internal region of the vehicle which is situated close to the combustion engine to be at the heat produced by the engine.

8. An arrangement according to claim 7, wherein the first EGR cooler is fitted to the combustion engine.

9. An arrangement according claim 1, wherein the second EGR cooler is fitted in a peripheral region of the vehicle through which region air at the temperature of the surroundings flows.

10. An arrangement according to claim 1, wherein the second EGR cooler is fitted in the internal region of the vehicle and forms part of a separate cooling circuit with a circulating liquid cooling medium.

11. An arrangement according to claim 10, wherein the vehicle includes a peripheral region and the separate cooling circuit further comprises a radiator element situated in the peripheral region of the vehicle and in which the circulating cooling medium is cooled by air which is at the temperature of the surroundings of the engine.

* * * * *